US008744111B2

(12) United States Patent
Chu

(10) Patent No.: US 8,744,111 B2
(45) Date of Patent: Jun. 3, 2014

(54) EARPHONE WITH TENSION DIAPHRAGM

(75) Inventor: Ming-Chung Chu, New Taipei (TW)

(73) Assignee: Eastern Technologies Holding Limited, Cayman Islands (KY)

( * ) Notice: Subject to any disclaimer, the term of this patent is extended or adjusted under 35 U.S.C. 154(b) by 0 days.

(21) Appl. No.: 13/603,343

(22) Filed: Sep. 4, 2012

(65) Prior Publication Data

US 2014/0064548 A1 Mar. 6, 2014

(51) Int. Cl.
*H04R 25/00* (2006.01)

(52) U.S. Cl.
USPC ..... 381/373; 381/370; 381/372; 381/380

(58) Field of Classification Search
USPC ..... 381/354, 370, 372, 373, 150, 337, 345, 381/346, 348, 353, 380
See application file for complete search history.

(56) References Cited

U.S. PATENT DOCUMENTS

2008/0002835 A1* 1/2008 Sapiejewski et al. ..... 381/71.6

* cited by examiner

*Primary Examiner* — Matthew Eason
(74) *Attorney, Agent, or Firm* — Chun-Ming Shih

(57) ABSTRACT

An earphone with tension diaphragm includes a front portion, a rear portion, a silicone gel earplug, a filtering net and a sound generating unit. As a user pushes the earphone into his ear, the diaphragm of the sound generating unit has a deformation and thus an air turbulence would be generated. This air turbulence would then cause a deformation of the tension diaphragm and this deformation would in turn eliminate the strange and unpleasant noises generated as a user pushes an earphone into his ear. Therefore, better audio signals may be achieved and a better low-frequency effect may be reached. Also, because the earphone of the present invention is water-resistant, it may be used under water. In addition, other water-resistant earphones on the market do not have such tension diaphragm.

3 Claims, 6 Drawing Sheets

EARPHONE WITH TENSION DIAPHRAGM

BACKGROUND OF THE INVENTION

1. Field of the Invention

The invention generally relates to an earphone. More particularly, the invention relates to an earphone provided with a tension diaphragm.

2. Description of the Prior Art

In the conventional earphone, a vibration diaphragm is actuated by an attached voice coil when an audio current is passed through the coil. The alternating magnetic field produced by the current through the coil reacts against the static magnetic field in turn, causing the coil and attached vibration diaphragm to move the air, thus producing sound. As a user inserts the earphone into his ear, the vibration diaphragm of the sound generating unit has a deformation and thus an air turbulence would be generated. This air turbulence would then cause a deformation of the vibration diaphragm, and strange and unpleasant noises will be generated by the vibration diaphragm.

In order to solve the problem, another conventional earphone comprises a front portion, a rear portion, a silicone gel earplug, a filtering net and a sound generating unit. The silicone gel earplug is fitted to a protruding portion of the front portion. The filtering net is attached at a proximal end of the protruding portion. The sound generating unit is disposed inside the front portion and the rear portion is fitted to the front portion. One or more air outlets are provided in the front portion to eliminate the strange noises generated by the diaphragm as the earphone is inserted into an ear. However, it is difficult for the right earphone to match the left earphone in terms of audio output.

SUMMARY OF THE INVENTION

The present invention is to provide an earphone with a front portion without any hole and without any strange noises generated by the vibration diaphragm. By adding a tension diaphragm in the earphone of the present invention, better low-frequency effect cancan be reached, and the earphone of the present invention is water-resistant.

The earphone of the present invention comprises a front portion, a rear portion, a silicone gel earplug, a filtering net and a sound generating unit. The silicone gel earplug is fitted to a protruding portion of the front portion. The filtering net is attached at a proximal end of the protruding portion. The sound generating unit is disposed inside the front portion and the rear portion is fitted to the front portion. A tension diaphragm is disposed inside the rear portion. As a user pushes the earphone into his ear, the vibration diaphragm of the sound generating unit has a deformation and thus an air turbulence would be generated. This air turbulence would then cause a deformation of the tension diaphragm and this deformation would in turn eliminate the strange and unpleasant noises generated as a user pushes an earphone into his ear.

The tension diaphragm seals off the rear portion and one or more of such tension diaphragm can be provided and have a variety of shapes to choose from. The tension diaphragm includes a flat base part. In addition, the flat base part is a metallic membrane, a macromolecular membrane or an organic membrane and may be made of one or more of such three types of membranes.

Moreover, the tension diaphragm also includes an upper part, a lower part. The upper part and lower part are made of a composite material, which is a metallic membrane, a macromolecular membrane or an organic membrane.

Furthermore, a circumferential supportive part is circumferentially provided around the flat base part.

In addition, a frame may be provided on the outmost portion of the flat base part to facilitate the manufacturing process.

In the present invention, as the user pushes the earphone into his ear, the deformation of the tension diaphragm eliminates the strange and unpleasant noises generated by the vibration diaphragm. In addition, with the minimum internal volume of the rear portion, an optimal low-frequency effect may be reached. Also, because the earphone of the present invention is water-resistant, it can be used under water. In addition, other water-resistant earphones on the market do not have such tension diaphragm.

DETAILED DESCRIPTION OF THE PREFERRED EMBODIMENT

The features and advantages of the present invention will be fully elaborated from the following detailed description of the accompanying drawings.

Figure 1:
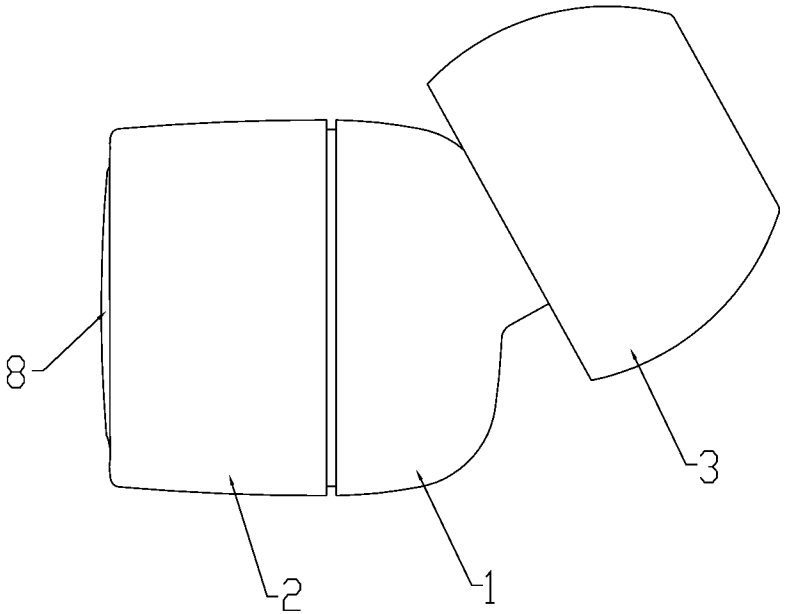
FIG. 1 is a view illustrating the earphone of the present invention in an assembled condition.
Figure 2:
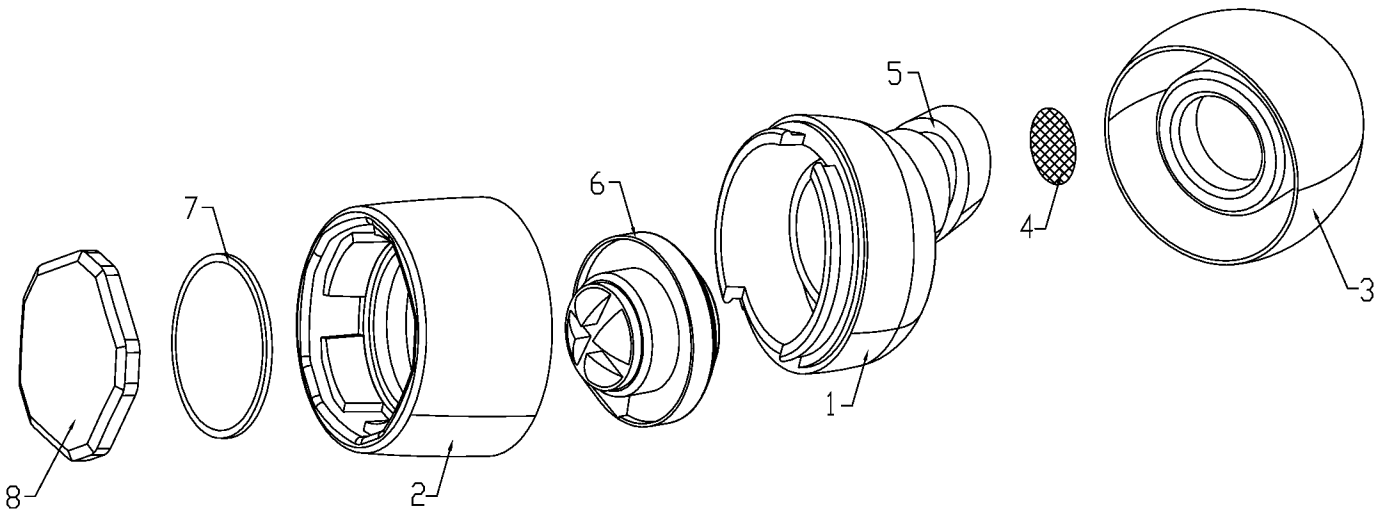
FIG. 2 is an exploded view of the earphone of the present invention.
Figure 3:
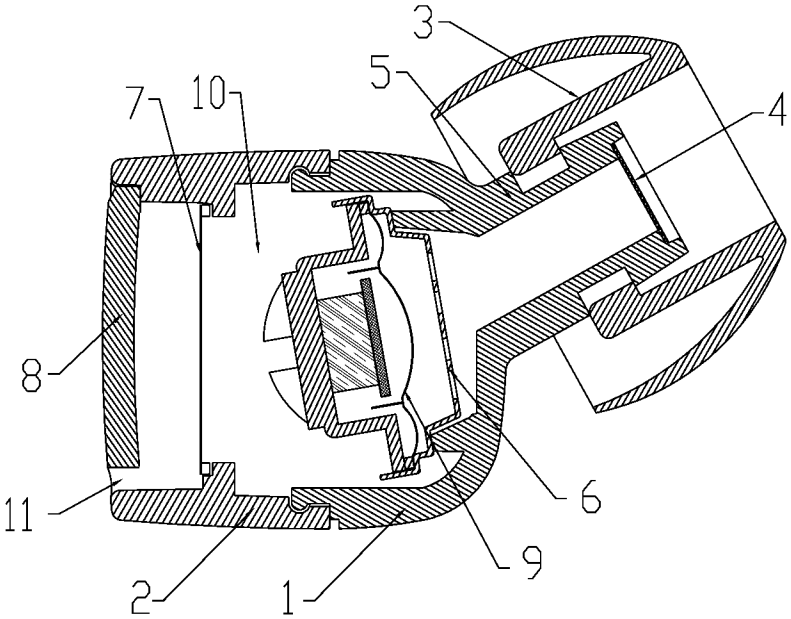
FIG. 3 is a sectional view of the earphone of the present invention.

Please refer to FIGS. 1-3. The earphone of the present invention comprises a front portion 1, a rear portion 2, a silicone gel earplug 3, a filtering net 4 and a sound generating unit 6. The silicone gel earplug 3 is fitted to a protruding portion 5 of the front portion 1. The filtering net 4 is attached at a proximal end of the protruding portion 5. The sound generating unit 6 is disposed inside the front portion 1 and the rear portion 2 is fitted to the front portion 1. A tension diaphragm 7 is disposed inside the rear portion 2. A decorative portion 8 is fitted to a distal end of the rear portion 2. An air outlet 11 is provided by the decorative portion 8. In addition, one or more tension diaphragms 7 may be disposed inside the rear portion 2.

Figure 4:
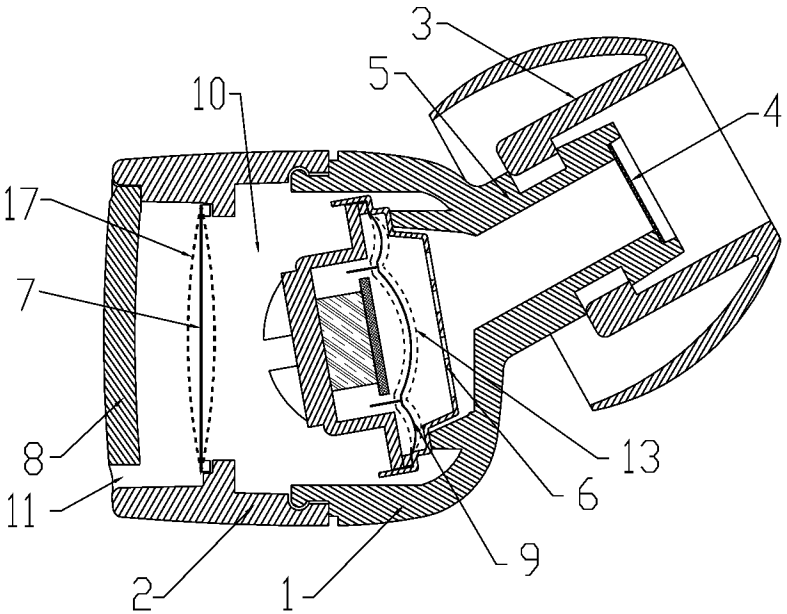
FIG. 4 is a sectional view illustrating how air flows in the earphone of the present invention.

Now, please see FIG. 4, which illustrates how air flows into the earphone of the present invention. As a user inserts the earphone into his ear, a vibration diaphragm 9 of the sound generating unit 6 has a deformation 13 and thus an air turbulence would be generated. This air turbulence would then cause a deformation 17 of the tension diaphragm 7 and this deformation 17 would in turn eliminate the strange and unpleasant noises generated as a user pushes an earphone into his ear.

Figure 5:
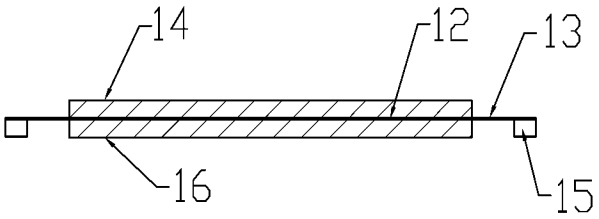
FIG. 5 is a sectional view illustrating the structure of the tension diaphragm.

Please see FIG. 5, which is a sectional view illustrating the structure of the tension diaphragm 7. The tension diaphragm 7 comprises a flat base part 12, a frame 15, an upper part 14, a lower part 16 and a circumferential supportive part 13. The circumferential supportive part 13 is circumferentially provided around the flat base part 12 and the frame 15 is provided on an outmost portion of the flat base part 12. The upper part 14 and lower part 16 are made of a composite material. The flat base part 12, upper part 14, lower part 16 are a metallic membrane, a macromolecular membrane or an organic membrane. The frame 15 is provided to facilitate the manufacturing process and thus the provision of the frame 15 is optional. The circumferential supportive part 13, flat base part 12, upper part 14 and lower part 16 may have a variety of shapes to choose from according to the internal shape and volume of the earphone. Therefore, the tension diaphragm 7 may be made of one or more layers of one or more composite materials. The upper part 14 and lower part 16 may be made of a composite material. The flat base part 12, upper part 14, lower part 16 are a metallic membrane, a macromolecular membrane or an organic membrane as long as the goal of tension is reached.

Figure 6:
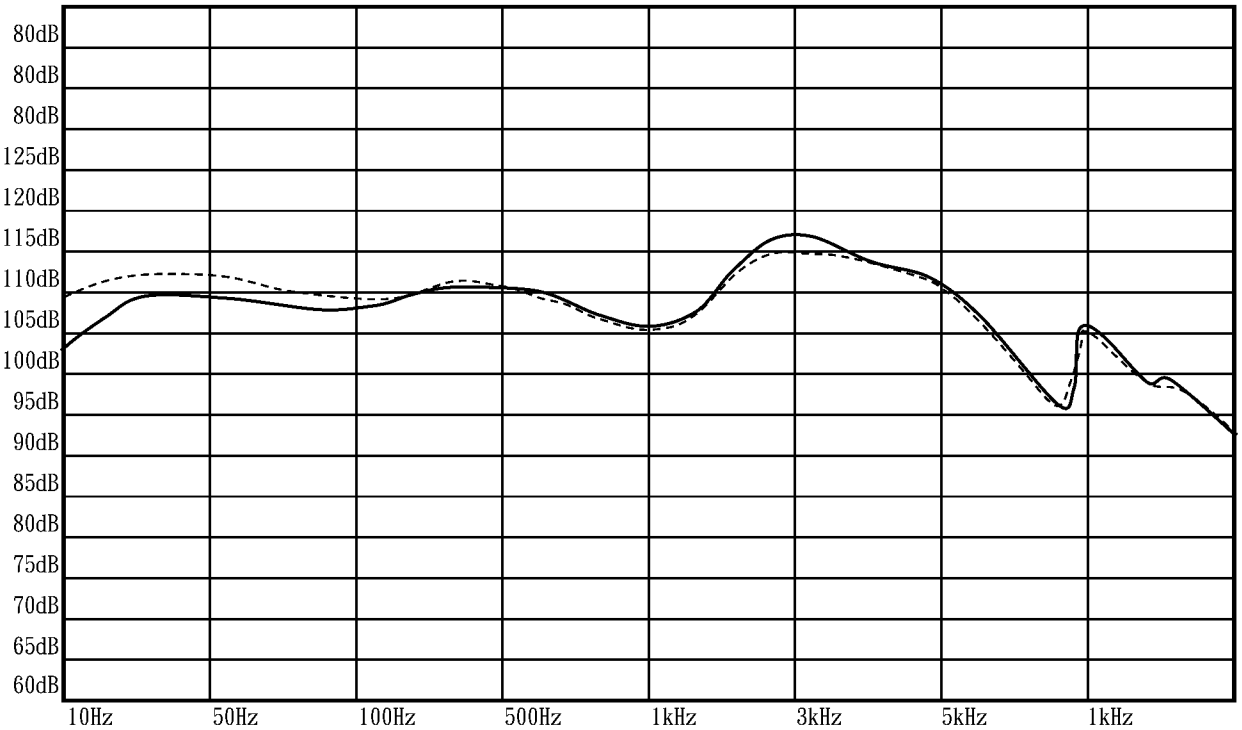
FIG. 6 is a graph illustrating a comparison of the earphone of the present invention and the earphone of the prior art in the test results by using an audio signal tester.

Please see FIG. 6, which is a graph illustrating a comparison of the earphone of the present invention and the earphone of the prior art in the test results by using an audio signal tester. The rear portion 2 of the earphone of the present invention and the rear portion of the conventional earphone have the same internal volume 10. The solid line represents the audio signals of the earphone of the present invention and the dotted line represents the audio signals of the earphone of the prior art. In the earphone of the present invention, thanks to the deformation 17, sound pressure can be increased and a better low-frequency effect may be reached.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. An earphone with tension diaphragm, comprising:

a front portion (1);

a rear portion (2), fitted to the front portion (1);

a silicone gel earplug (3), fitted to a protruding portion (5) of the front portion (1);

a filtering net (4), attached at a proximal end of the protruding portion (5);

a sound generating unit (6), disposed inside the front portion (1), having a vibration diaphragm actuated by an attached voice coil when an audio current is passed through the coil;

a tension diaphragm (7) disposed inside the rear portion (2), wherein the tension diaphragm (7) comprises a flat base part (12), a frame (15), an upper part (14), a lower part (16) and a circumferential supportive part (13), and wherein the upper part (14) and lower part (16) are made of a composite material, and wherein the circumferential supportive part (13) is circumferentially provided around the flat base part (12) and the frame (15) is provided on the outmost portion of the flat base part (12);

a decorative portion (8) fitted to a distal end of the rear portion (2), and an air outlet (11) formed on the decorative portion (8), thereby as a user pushes the earphone into his ear, the vibration diaphragm of the sound generating unit has a deformation and thus an air turbulence is generated, and the air turbulence then causes a deformation of the tension diaphragm, which in turn eliminates strange and unpleasant noises generated.

2. The earphone with tension diaphragm as in claim 1, wherein the flat base part (12) is a metallic membrane, a macromolecular membrane or an organic membrane and may have a variety of shapes to choose from.

3. The earphone with tension diaphragm as in claim 1, wherein the circumferential supportive part (13), flat base part (12), upper part (14) and lower part (16) may have smooth surfaces or protruding patterns.

* * * * *